US009738001B2

(12) United States Patent
Safar

(10) Patent No.: US 9,738,001 B2
(45) **Date of Patent: *Aug. 22, 2017**

(54) FINGERTIP SHAVING DEVICE

(71) Applicant: Samir Hanna Safar, San Diego, CA (US)

(72) Inventor: Samir Hanna Safar, San Diego, CA (US)

(73) Assignee: Samir Hanna Safar, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/622,880

(22) Filed: Feb. 15, 2015

(65) Prior Publication Data

US 2015/0202783 A1 Jul. 23, 2015

Related U.S. Application Data

(63) Continuation-in-part of application No. 13/723,060, filed on Dec. 20, 2012, now Pat. No. 8,991,060.

(51) Int. Cl.
*B26B 21/52* (2006.01)
*B26B 21/40* (2006.01)

(52) U.S. Cl.
CPC ..... *B26B 21/527* (2013.01); *B26B 21/4043* (2013.01)

(58) Field of Classification Search
CPC ..... B26B 21/52; B26B 21/522; B26B 21/527; B26B 21/56; B26B 21/4043; B26B 21/4068
USPC ... 30/34.1, 34.05, 43.4–43.6, 29.5, 526–537, 30/298, 232, 240, 198; 407/7, 29.11; 451/524, 525
See application file for complete search history.

(56) References Cited

U.S. PATENT DOCUMENTS 2,040,599 A * 5/1936 Davies ..... A45D 26/0004 132/333
2,708,376 A * 5/1955 Booth ..... B23D 71/00 76/104.1
4,590,674 A * 5/1986 Harper ..... B26B 21/56 30/49
4,807,360 A * 2/1989 Cerier ..... B26B 21/56 30/346.5

(Continued)

FOREIGN PATENT DOCUMENTS

CN 101758507 6/2010
GB 2465422 5/2010

(Continued)

*Primary Examiner* — Stephen Choi
*Assistant Examiner* — Evan MacFarlane

(57) ABSTRACT

A fingertip mountable shaving device is provided by a flexible and breathable substrate layer including a first shaving surface, and a second adhesive surface opposite to the first shaving surface. The first shaving surface includes a rubber strip along the vertical peripheral edge and a plurality of blade assemblies affixed at predetermined locations. The blade assemblies include a single or double rotary blade assembly of different diameters and having a hemispherical protective cap with a vertical stem, on the top, which are mounted on blade mounts provided as an integral unit of the base layer. The device can safely and closely shave hair from the face and other difficult to reach body surfaces, such as within the ear or nostrils.

12 Claims, 14 Drawing Sheets

(56) References Cited

U.S. PATENT DOCUMENTS

| | | | | |
|---|---|---|---|---|
| 4,977,670 | A * | 12/1990 | Iten | B26B 21/00 30/49 |
| 5,357,680 | A | 10/1994 | Monistere | |
| D386,819 | S | 11/1997 | Doyle | |
| 5,802,720 | A * | 9/1998 | Pribe | B26B 21/00 30/32 |
| D410,112 | S | 5/1999 | Doyle | |
| 6,018,877 | A | 2/2000 | Greene | |
| 6,029,356 | A | 2/2000 | Sprinkle | |
| 6,505,403 | B1 * | 1/2003 | Andrews | B26B 21/00 30/29.5 |
| 6,550,148 | B2 | 4/2003 | Cecil | |
| 2005/0011084 | A1 * | 1/2005 | Stephenson | A43C 13/00 36/15 |
| 2010/0037414 | A1 * | 2/2010 | Dimos | E04G 23/0203 15/245.1 |
| 2011/0113631 | A1 | 5/2011 | Zdunek | |

FOREIGN PATENT DOCUMENTS

| | | |
|---|---|---|
| JP | 6154436 | 6/1994 |
| JP | 2002018160 | 1/2002 |
| JP | 2009039186 | 2/2009 |
| WO | WO/2012/107713 | 8/2012 |

* cited by examiner

FINGERTIP SHAVING DEVICE

CROSS-REFERENCE TO RELATED APPLICATIONS

The present application is a continuation-in-part of currently pending U.S. patent application Ser. No. 13/723,060, filed on Dec. 20, 2012, which is hereby incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The present invention relates to a hair shaving device, more specifically to a fingertip mountable and manually operated shaving device. The invention aims to provide a flexible and disposable hair shaving device, suitable for single use that allows safe and close shaving particularly from difficult to access body parts by relying on the sense of feel rather than visibility of the surface to be shaved.

Background Art

Different finger mountable shaving devices used to shave hair from difficult to access body parts such as nostrils or ears are known in prior art. These devices range from manually operated to battery powered devices and may or may not be disposable. Many of these devices are bulky and are not easy to carry or use inside the nose, ears or on wrinkled skin surface.

Several such shaving devices included in the prior art are known to the inventor, but they distinctly differ from the present invention described in this patent application. The present invention offers a solution the above mentioned problems associated with prior art.

Below are given some prior art references. U.S. Pat. No. 6,550,148, issued on Apr. 22, 2003, titled, "SHAVING METHOD AND APPARATUS", describes a shaving device wherein the razor is placed between the user's fingers and held by the combined grip. This device is not suitable for shaving intricate body surfaces such as those inside the nose or ears.

U.S. Pat. No. 6,029,356, issued on Feb. 29, 2000, titled, "FINGER PAD SENSOR RAZOR", discloses a razor mounted on full or partial rings which slide all the way over the fingers to their proximal ends to be used as sensory feed-back means of hair stubble condition. This device too is not suitable for shaving intricate body surfaces such as those inside the nose or ears.

U.S. Pat. No. 6,018,877, issued on Feb. 1, 2000, titled, "VERSATILE FINGER RETAINED RAZOR", provides a finger engaged razor that is configured for selectively shaving the head or face. This device is also unsuitable for shaving intricate body surfaces such as those inside the nose or ears.

U.S. Pat. No. 6,505,403, issued on Jan. 14, 2003, titled, "HAIR SHAVING DEVICE WITH U-SHAPED RAZOR BLADE STRIP", provides a manually manipulatable non electric hair trimming device, which is neither flexible nor disposable.

U.S. Patent Application No. 20110113631, published on May 19, 2011, titled, "APPARATUS AND METHOD OF HOLDING RAZORS", provides a razor holder for use with a plurality of razor elements and includes a hand wearable article configured to fit over a hand of a user. This shaving device is also not suitable for shaving intricate body surfaces such as those inside the nose or ears.

U.S. Pat. No. 5,357,680, issued on Oct. 25, 1994, titled, "FINGER RAZOR", provides a finger razor that completely fits snugly onto the middle or index finger. This is a rigid device that is unsuitable for shaving intricate body surfaces such as those inside the nose or ears.

PCT Patent Application No. WO/2012/107713, published on Aug. 16, 2012, titled, "A RAZOR", provides a razor which is placed on at least one finger of the user's hand and has at least one blade. This device also involves use of a rigid surface that is unsuitable for shaving intricate body surfaces such as those inside the nose or ears.

UK Patent No. GB2465422, issued on May 26, 2010, titled, "FINGER-MOUNTED DISPOSABLE SHAVING RAZOR", provides a razor mounted on a band to be placed on a finger. This device also involves use of a rigid surface that is unsuitable for shaving intricate body surfaces such as those inside the nose or ears.

Chinese Patent Application No. CN 101758507, published on Jun. 30, 2010, titled, "FINGER-HELD DOUBLE-SIDED RAZOR", relates to a finger-held double-sided razor, which is again a rigid device unsuitable for shaving intricate body surfaces such as those inside the nose or ears.

Chinese Patent Application No. CN 202180480, published on Apr. 4, 2012, titled, "RAZOR", relates to a finger worn razor, which is again a rigid device unsuitable for shaving intricate body surfaces such as those inside the nose or ears.

Japanese Patent Application No. JP 2009039186, published on Feb. 26, 2009, titled, "DOUBLE-EDGED FINGER RAZOR WITH BAND", describes a double-edged finger razor which is again a rigid device unsuitable for shaving intricate body surfaces such as those inside the nose or ears.

Japanese Patent Application No. JP 2002018160, published on Jan. 22, 2002, titled, "FINGER INSERTION TYPE SAFETY RAZOR", provides a razor edge holding part that can be worn over a finger. However this is a rigid device unsuitable for shaving intricate body surfaces such as those inside the nose or ears.

Japanese Patent No. 6154436, issued on Jun. 3, 1994, titled, "HAND/FINGER TOUCHING TYPE SAFETY RAZOR", provides hand/finger touching type safety razor that can be worn on a single or multiple fingers. However this is also a rigid device unsuitable for shaving intricate body surfaces such as those inside the nose or ears.

U.S. Design Pat. No. D410112, issued on May 18, 1999, titled, "FINGER-MOUNTED RAZOR", provides an ornamental design for a finger-mounted razor which is unsuitable for shaving intricate body surfaces such as those inside the nose or ears.

U.S. Design Pat. No. D386819, issued on Nov. 25, 1997, titled, "FLEXIBLE FINGER-MOUNTED RAZOR", provides an ornamental design for a finger-mounted razor which is unsuitable for shaving intricate body surfaces such as those inside the nose or ears.

In currently pending pending U.S. patent application Ser. No. 13/723,060, filed on Dec. 20, 2012, the inventor disclosed a fingertip shaving device that overcame the limitations of prior art. The present invention disclosed in this application provides improvement in shaving performance and enhances ease of manufacturing the fingertip shaving device.

None of the previously described prior art references provide a shaving device that is capable of being mounted on a fingertip and is flexible, disposable, small, light in weight, easy to operate, ease to manufacture commercially, non-electric, facilitates shaving by feel, and also provides a safe and close saving finish while accessing intricate body parts. The present invention satisfies the present and other needs.

BRIEF SUMMARY OF THE INVENTION

The present invention provides for a non-electric, disposable and flexible fingertip mountable shaving device that offers a safe and close shaving finish. A shaving device in accordance with the present invention is characterized by a flexible and breathable substrate layer comprising a first shaving surface having a base layer with a plurality of blade assemblies, and a second adhesive surface configured for temporarily adhering to the human skin, wherein the second adhesive surface is on an opposing side of the flexible substrate layer from the first shaving surface.

A member of the plurality of blade assemblies may be provided as a single rotary blade assembly or as a double rotary blade assembly.

The first shaving surface includes a base layer having a vertical peripheral edge, and a plurality of blade assemblies are mounted on blade mounts provided on the base layer as an integral unit. A dome pin holds the blade assembly in place. The dome pin is characterized by a vertical stem and extending into a hemi-spherical protective cap along its upper edge and extending into a snap button fastener along its lower edge. The snap button fastener includes a cap and a button, where the cap is an extension of the lower edge of the vertical stem of the dome pin, and the button is configured to engage with the cap is provided on the opposite side of the first shaving surface to secure a member of the plurality of blade assemblies.

In another embodiment referred as the double rotary blade assembly, a second rotary blade member is stacked vertically above the first rotary blade and the dome pin passes through the respective central openings.

The blades have been provided with notches and complimentary notch engaging portions so as to affix the blade assembly on the blade mount. The dome pins are also provided with protective spines to cover the sharp edges of the blades.

The snap button provides means to fasten the blade assembly which simplifies the manufacturing process.

In an alternate embodiment referred as the fish scale shaver assembly, blade mounts of varying height are provided on the base layer at predetermined locations.

The second adhesive surface is coated with an adhesive suitable for application on the human skin and is covered with a releasably connected protective peel off layer. The second adhesive surface is provided on the vertically opposite side of the first shaving surface.

The second adhesive surface is used for temporarily affixing the shaving device on the finger tip and the first shaving surface is used to shave hair from the face and other difficult to reach body surfaces, such as within the ear or nostrils.

The primary object of the present invention is to provide a shaving device that can safely and closely shave areas that are difficult to see and access such as, within the ear, nostrils, back of the neck.

A further object is to provide a shaving device that is easy to assemble and manufacture.

Another object of the present invention is to provide a shaving device that facilitates shaving by feel and does not require a visual aid such as a mirror while shaving.

A further object of the present invention is to provide a shaving device that is flexible and easily conforms to the contours of the skin surface to be shaved as well as the fingertip.

A still further object of the present invention is to provide a shaving device that is small in size, light in weight, easy to carry and comfortable to use.

Yet another object of the present invention is to provide a shaving device that is disposable and suitable for single use.

Yet further object of the present invention is to provide a shaving device that is not powered by any electrical source and can be conveniently operated manually.

Yet another object of the present invention is to provide a shaving device that allows shaving in multiple directions.

Still another object of the present invention is to provide a shaving device that is self adhesive in nature and does not require additional effort on part of the user to specifically hold in place by the user.

These and other objects of the present invention are further elaborated in the detailed description of the invention. These objects should be construed to be merely illustrative of some of the more prominent features and applications of the invention and not as to limit the scope of the invention. Applying or modifying the disclosed invention in a different manner can attain many other beneficial results or modifying the invention as will be described. Accordingly, referring to the following drawings may have a complete understanding of the invention. Description of the preferred embodiment is as follows.

BRIEF DESCRIPTION OF THE SEVERAL VIEWS OF THE DRAWINGS

For a better understanding of the present invention and its various embodiments, reference is made to the following detailed description to be read in conjunction with the accompanying drawings, wherein.

Figure 1:
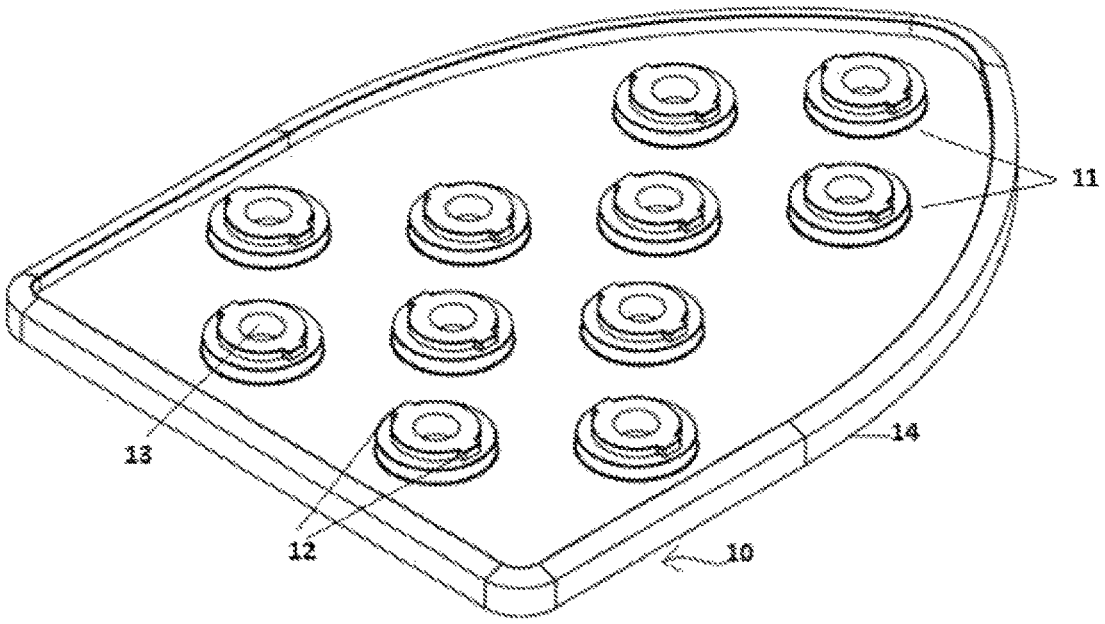
FIG. 1 shows a top perspective view of the base layer with integral base mounts.

It should be understood that drawings are for the purpose of illustrating the concepts of the invention and are not to scale.

LIST OF REFERENCE NUMBERING

10 labels a base layer having a plurality of base mounts integral to it
11 labels a base mount
12 labels notch engagement portions of the base mount
13 labels a central opening of the base mount
14 labels a vertical peripheral edge of the base layer
20 labels a first rotary blade
22 labels notches of the first rotary blade
23 labels a central opening of the first rotary blade
30 labels a second rotary blade
32 labels notch engagement portions of the second rotary blade
33 labels a central opening of the second rotary blade
40 labels a dome pin having a cap with spines, in one embodiment of the invention
41 labels a dome pin having a cap without spines, in an alternate embodiment of the invention
42 labels a vertical stem
43 labels a cap without spines
44 labels a cap with spines
46 labels a snap button fastener
48 labels a plurality of spines
50 labels a protective peel off layer
53 labels cap portion of snap button fastener
54 labels button portion of snap button fastener
60 labels a single blade shaver assembly with dome pins having caps with spines in one embodiment of the invention
70 labels a single blade shaver assembly with dome pins having caps without spines in one embodiment of the invention
80 labels a double blade shaver assembly with dome pins having caps with spines in one embodiment of the invention
90 labels a double blade shaver assembly with dome pins having caps without spines in one embodiment of the invention
94 labels a base layer of the fish scale shaver assembly in one embodiment of the invention
95 labels a fish scale shaver assembly with dome pins having caps without spines in one embodiment of the invention
96 labels a thin blade mount
97 labels a thick blade mount
98 labels a fish scale shaver assembly with dome pins having caps with spines in one embodiment of the invention
99 labels a scrubber in one embodiment of the invention
42A labels a vertical stem in an embodiment of the invention, which includes a dome pin having a cap without spines
46A labels a a snap button fastener in an embodiment of the invention which includes a dome pin having a cap without spines
53A labels cap portion of snap button fastener in an embodiment of the invention, which includes a dome pin having a cap without spines

DETAILED DESCRIPTION OF THE INVENTION

The present invention is now described with reference to the drawings.

Referring to FIG. 1, 10 depicts a base layer characterized by a plurality of base mounts 11. A base mount 11 is a raised vertical projection which has a central opening. 11 serves as a platform for holding a blade assembly. A plurality of base mounts are provided as integral components of the base layer. In different embodiments of the invention, base mounts 11 are provided at predetermined locations and with may have different or same dimensions. Rotary blades are assembled on top of these base mounts. 14 is a rubber strip on a vertical peripheral edge running along the base layer 10.

Each base mount 11 is provided with notch engagement portions 12 and a central opening 13. In a preferred embodiment, two notch engagement portions are provided in a symmetric fashion.

Figure 2:
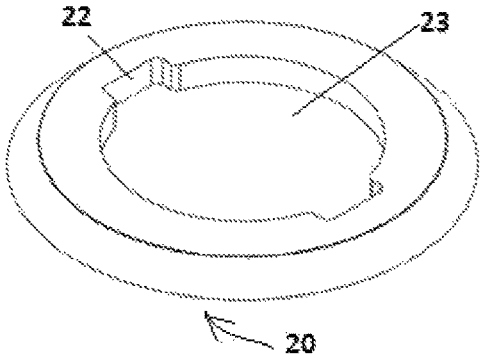
FIG. 2 shows an enlarged, perspective view of the first rotary blade.

Referring to FIG. 2, 20 depicts a first rotary blade having a complimentary number and configuration of notches 22 to engage with the respective notch engagement portions 12 of the base mount. 20 is also provided with a central opening 23. The shape of the first rotary blade is substantially circular, although oval or elliptical shapes may also be employed.

Figure 3:
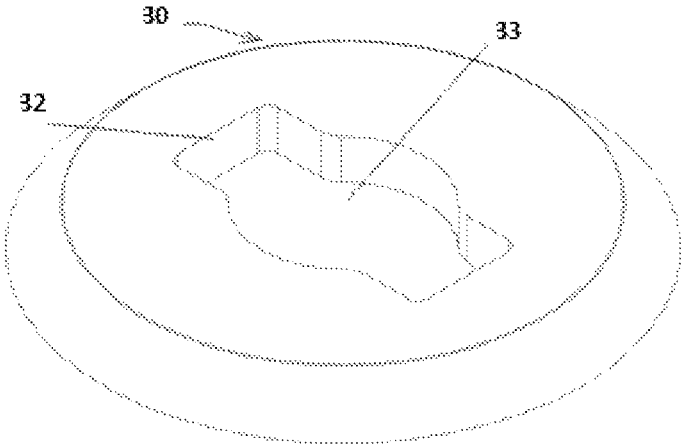
FIG. 3 shows an enlarged, perspective view of the second rotary blade.

Referring to FIG. 3, 30 depicts a second rotary blade having a complimentary number and configuration of notches 32 to engage with notch engagement portions 22 of the first rotary blade. 30 is also provided with a central opening 33. The shape of the first rotary blade is substantially circular, although oval or elliptical shapes may also be employed.

In alternate embodiments of the invention, the second rotary blade 30 is has a diameter preferably lesser than the first rotary blade 20 and is positioned on top of the first rotary blade 20, which in turn is mounted on the base mount 11.

Figure 4:
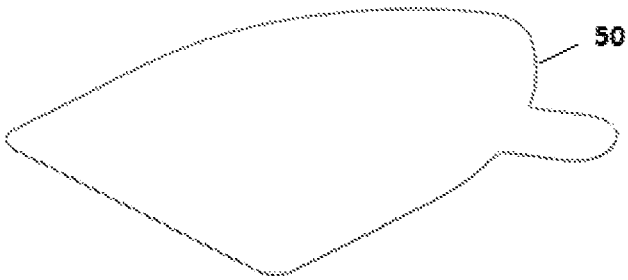
FIG. 4 depicts the protective peel off layer forming the second adhesive surface of the shaving device in an embodiment of the invention.

Referring to FIG. 4, 50 depicts a protective peel off layer. A shaving device in accordance with the invention is provided with a first shaving surface and a second adhesive surface on opposite sides of its transversal axis. The second adhesive surface is coated with an adhesive suitable for application on the human skin and includes the releasably connected protective peel off layer 50. The protective peel off layer 50 is attached to the second adhesive surface using any suitable adhesive or bonding method.

In an alternate embodiment referred to as the fish scale shaver assembly, the peel off layer 50 is provided in a specific shape which is substantially triangular.

Figure 5:
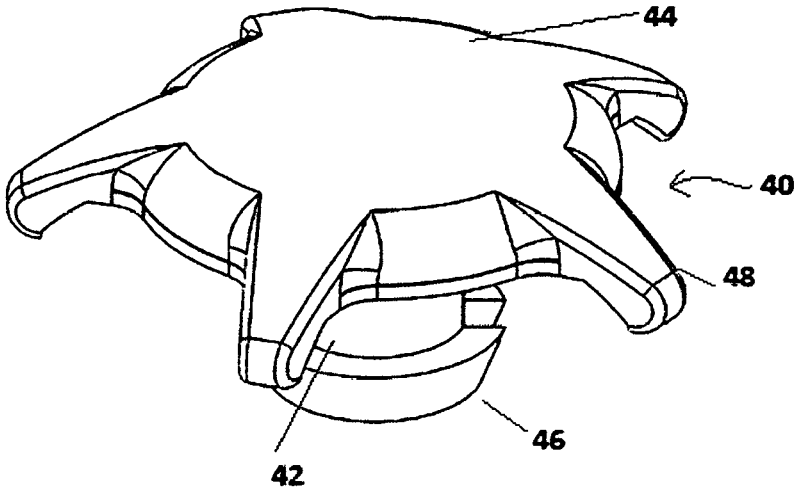
FIG. 5 depicts an enlarged, perspective view of the dome pin with spines, in one embodiment of the invention.

Referring to FIG. 5, 40 depicts a dome pin with a vertical stem 42, extending upwards into a substantially hemispherically shaped cap 44 having a plurality of spines 48. The vertical stem 42 extends downwards into a snap button fastener 46, in one embodiment of the invention. This embodiment of the dome pin having protective spines arranged in a star shaped configuration along the cap 44 is configured to bend over the sharp edges of the rotary blades so as to prevent unwanted cuts to the finger of the user and is referenced by 40, in this application.

In a preferred embodiment, the plurality of spines 48 are provided with a tapering thickness towards the outer edges to facilitate prevent skin injuries from the rotary blades and also avoid breakage of the spines.

Figure 6:
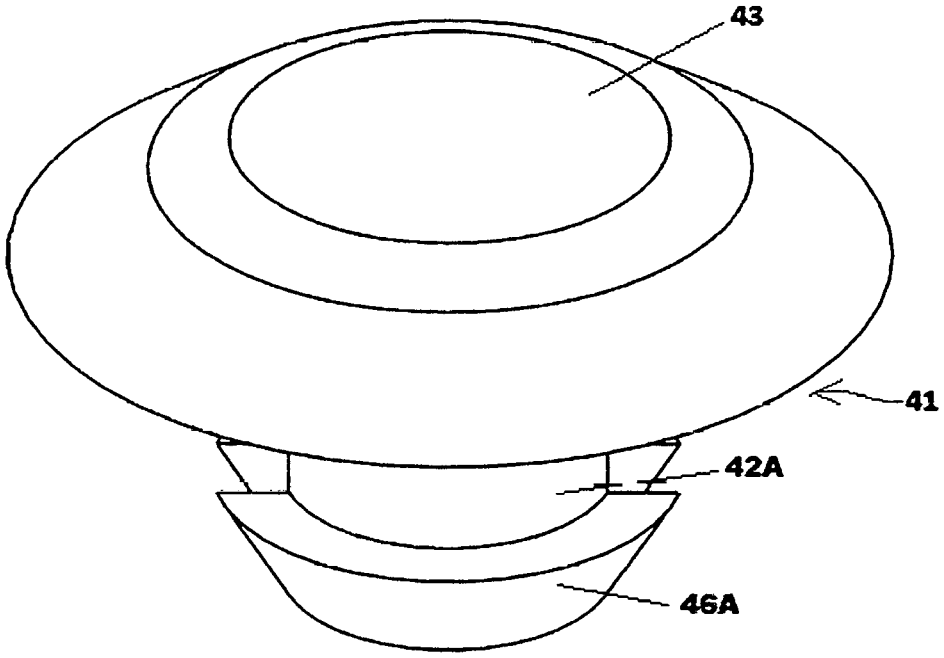
FIG. 6 depicts an enlarged, perspective view of the dome pin without spines in an alternate embodiment of the invention.

Referring to FIG. 6, 41 depicts a dome pin with a vertical stem 42A extending upwards into a substantially hemispherically shaped cap 43. The vertical stem 42A extends downwards into a snap button fastener 46A, in one embodiment of the invention. This embodiment of the dome pin without the spines on the cap 43 is referenced by 41, in this application.

Figure 7:
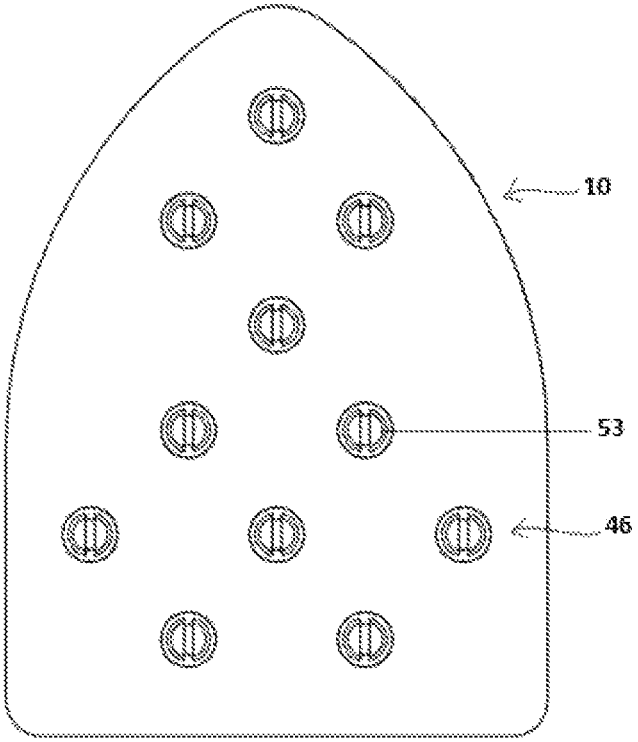
FIG. 7 depicts the bottom view of the base layer.
Figure 11:
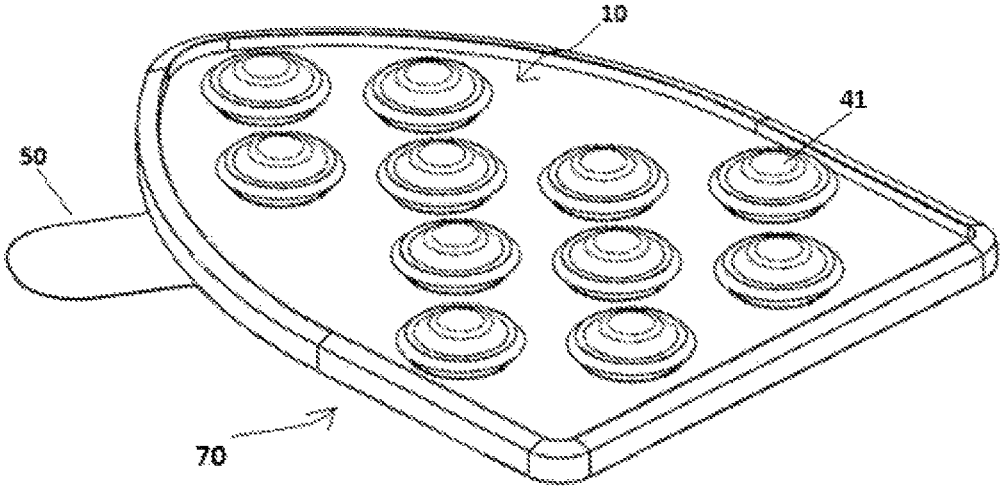
FIG. 11 depicts a perspective view of a shaving device with a plurality of single blade shaver assemblies with dome pins having caps without spines, in one embodiment of the invention.

Referring to FIG. 7, the bottom view of the base layer 10 of the first shaving surface of the present invention is displayed, wherein snap button fasteners 46 which secure the blade assemblies in place on the opposite side of the first shaving surface, can be viewed. The second adhesive surface, not shown in FIG. 11, is aligned and affixed on the bottom side of the first shaving surface, after the plurality of blades assemblies is assembled and the snap button fastener secures and holds the entire assembly firmly and non-removably.

Figure 8:
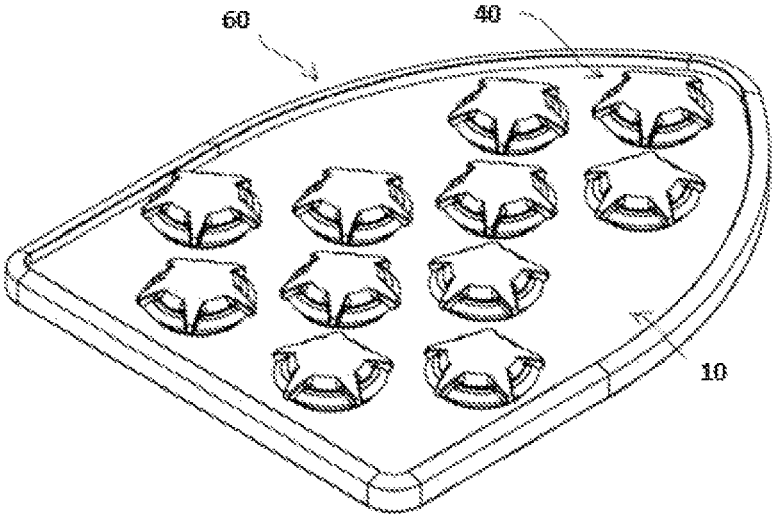
FIG. 8 depicts a perspective view of a shaving device with a plurality of single blade shaver assemblies with dome pins having caps with spines, in one embodiment of the invention.

Referring to FIG. 8, a perspective view of 60 is shown. Here 60 depicts a shaving device provided with a plurality of single blade assemblies having dome pins with spines 40 mounted on base layer 10, in one embodiment of the invention.

Figure 9:
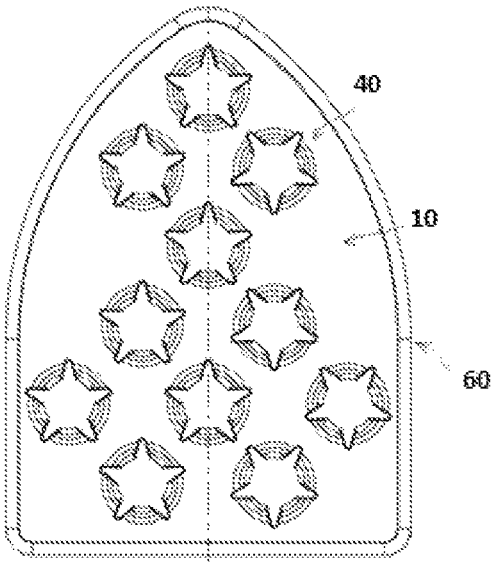
FIG. 9 depicts a top view of a shaving device with a plurality of single blade shaver assemblies with dome pins having caps with spines, in one embodiment of the invention.

Referring to FIG. 9, a top view of 60 is shown. Here 60 depicts a shaving device provided with a plurality of single blade assemblies having dome pins with spines 40 mounted on base layer 10, in one embodiment of the invention.

Figure 10:
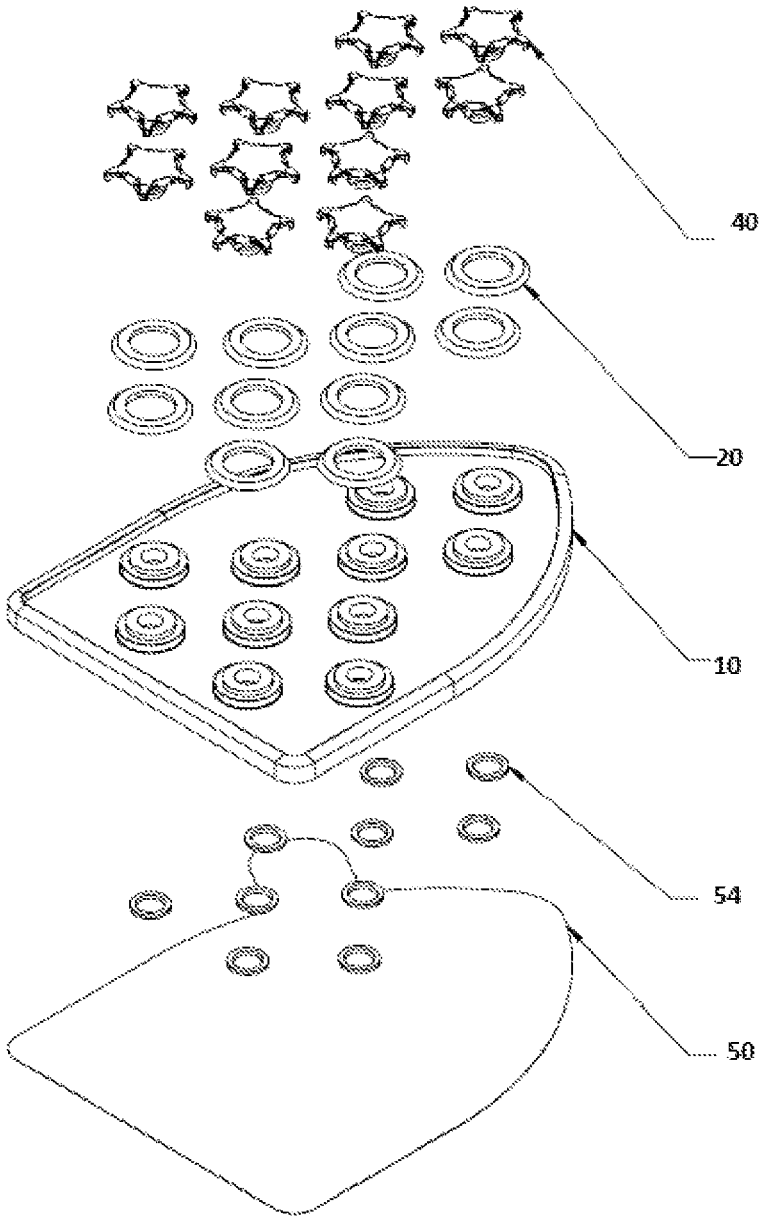
FIG. 10 depicts an exploded view of a shaving device with a plurality of single blade shaver assemblies with dome pins having caps with spines, in one embodiment of the invention.

Referring to FIG. 10, an exploded view of the shaving device characterized by a plurality of single blade assemblies having dome pins with spines 40, a plurality of top layer members 20, the base layer 10, a plurality of button portion of snap button fastener 54 and protective peel off layer 50 are shown.

Referring to FIG. 11, a perspective view of 70 is shown. Here 70 depicts a shaving device provided with a plurality of single blade assemblies having dome pins without spines 41 mounted on base layer 10, and protective peel off layer 50 as per one embodiment of the invention.

Figure 12:
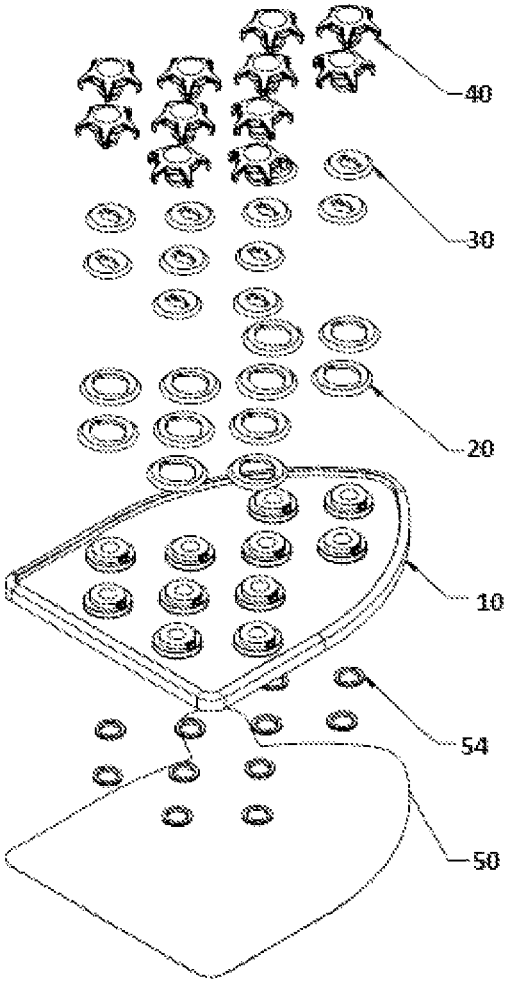
FIG. 12 depicts an exploded view of a shaving device with a plurality of double blade shaver assemblies with dome pins having caps with spines, in one embodiment of the invention.

Referring to FIG. 12, an exploded view of the shaving device characterized by a plurality of double blade assemblies having dome pins with spines 40, a plurality of second rotary blades 30, a plurality of first rotary blades 20, the base layer 10, a plurality of button portion of snap button fastener 54 and protective peel off layer 50 are shown.

Figure 13:
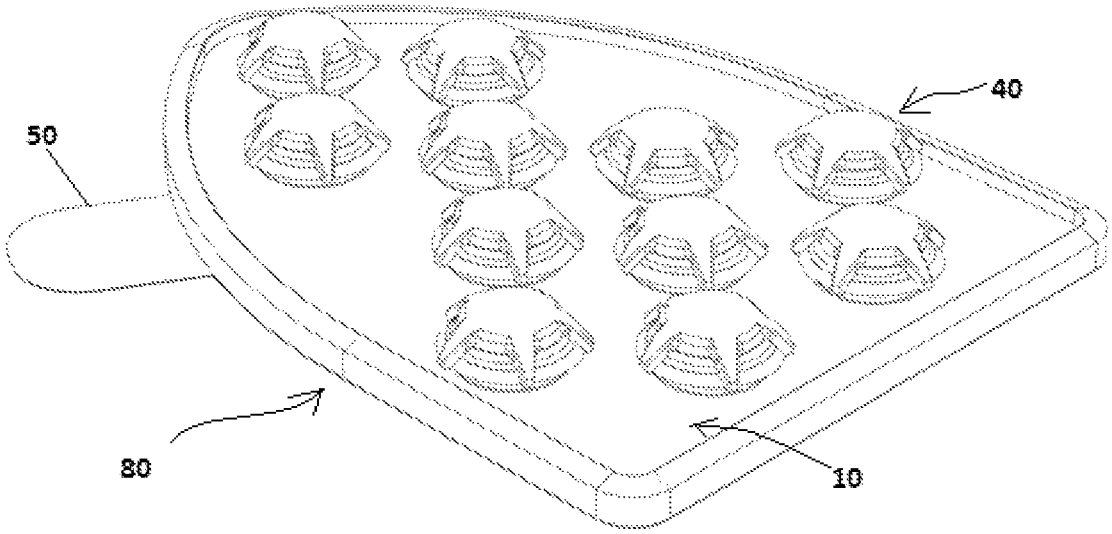
FIG. 13 depicts a perspective view of a shaving device with a plurality of double blade shaver assemblies with dome pins having caps with spines, in one embodiment of the invention.

Referring to FIG. 13, a perspective view of 80 is shown. Here 80 depicts a shaving device provided with a plurality of double blade assemblies having dome pins with spines 40 mounted on base layer 10, and a peel off layer 50, in one embodiment of the invention.

Figure 14:
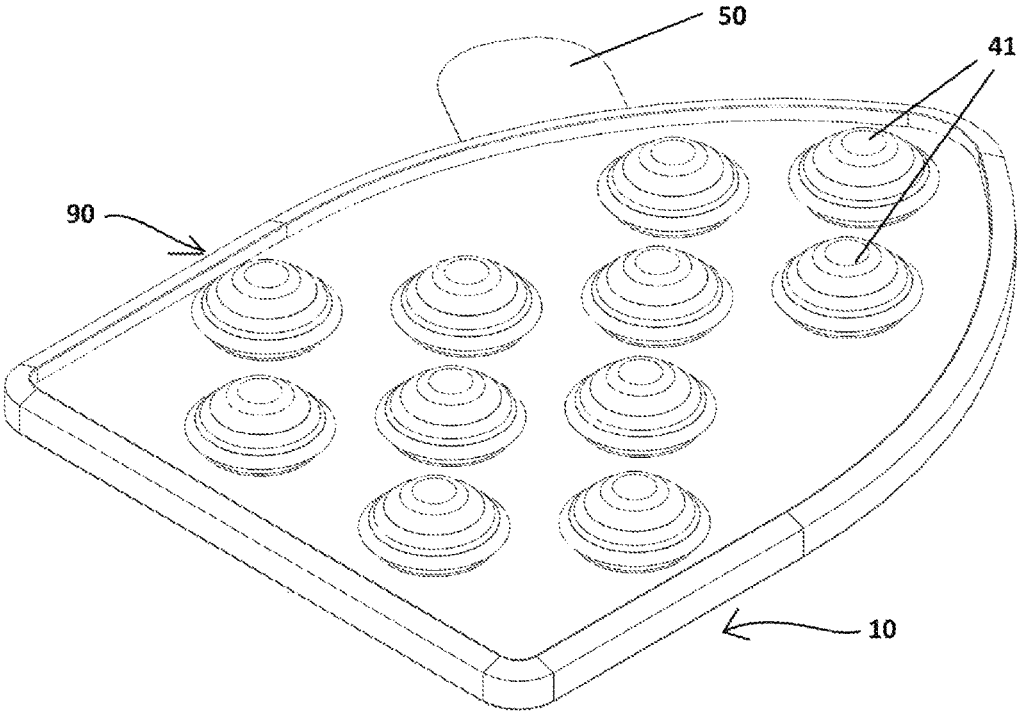
FIG. 14 depicts a perspective view of a shaving device with a plurality of double blade shaver assemblies with dome pins having caps without spines, in one embodiment of the invention.

Referring to FIG. 14, a perspective view of 90 is shown. Here 90 depicts a shaving device provided with a plurality of double blade assemblies having dome pins without spines 41 mounted on base layer 10, and a peel off layer 50, in one embodiment of the invention.

Figure 15:
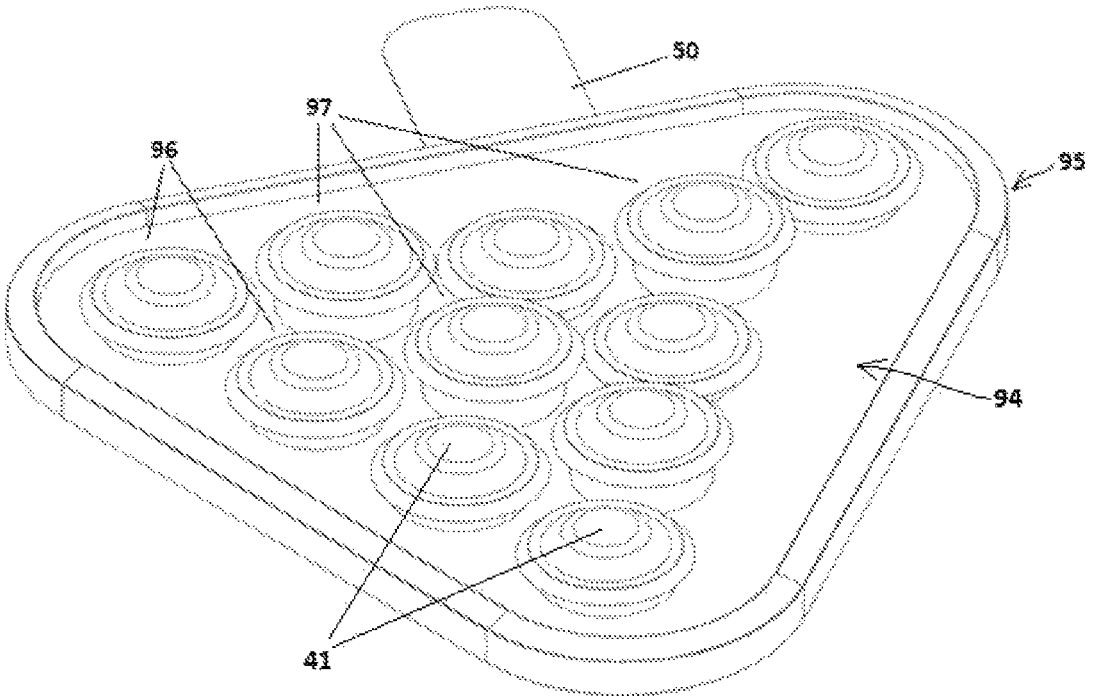
FIG. 15 depicts a perspective view of a shaving device with a plurality of single blade shaver assemblies of different heights, with dome pins having caps without spines, in one embodiment of the invention, referred as the fish scale shaver.

Referring to FIG. 15, a perspective view of 95 is shown. Here 95 depicts an embodiment of the invention, referred as a fish scale embodiment of the shaving device. In the present embodiment, a plurality of single blade assemblies having varying heights are provided. Blade assemblies are mounted on blade mounts of lesser thickness, referred to as thin blade mounts 96 and blade assemblies of higher thickness are referred to as thick blade mounts 97 in this application, While the difference in heights of the blade assemblies is achieved by providing blade mounts of varying heights at predetermined locations and dimensions, it provides better shaving quality. For illustrative purpose, base mounts of two different heights are depicted, although base mounts of any number of variation in height may be provided.

In alternate embodiments, the fish scale shaver may have single blade assemblies or double blade assemblies.

In the present embodiment, shaving device 95 uses dome pins without spines 41 for blade assemblies on thin blade mounts 96 as well as blade assemblies on thick blade mounts 97. 96 and 97 are integral parts of base layer 94. In a preferred embodiment, the shape of 94 is triangular. Protective peel off layer 50 is also provided.

Figure 16:
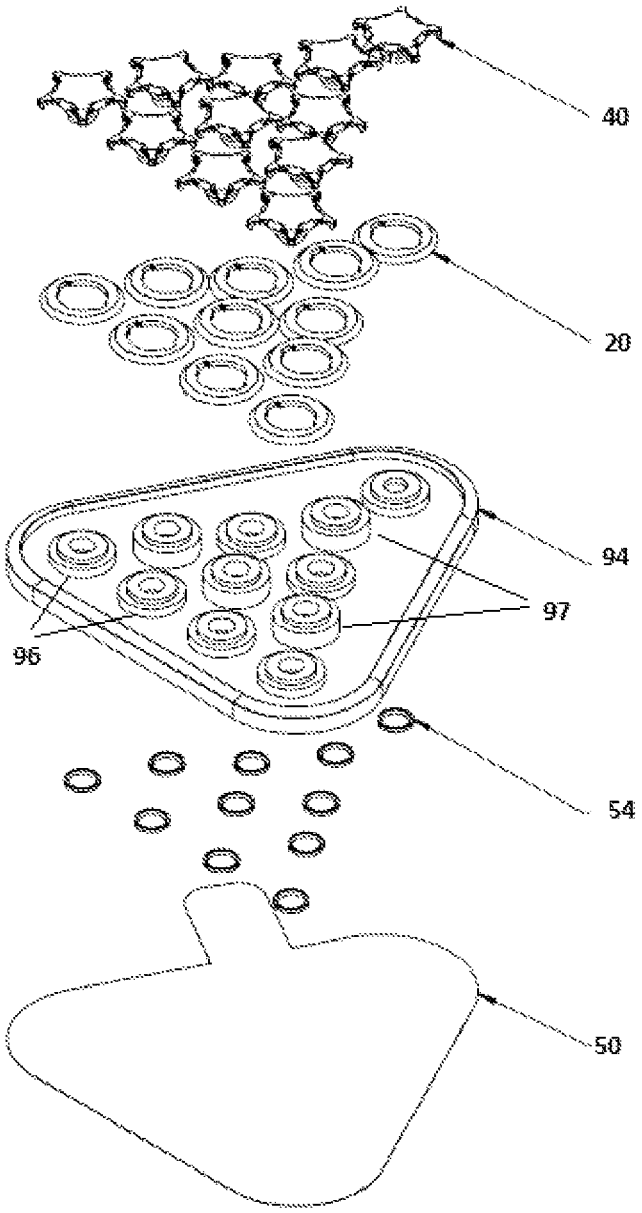
FIG. 16 depicts an exploded view of a shaving device with a plurality of single blade shaver assemblies of different heights, with dome pins having caps with spines, in one embodiment of the invention, referred as the fish scale shaver.

Referring to FIG. 16, an exploded view of fish scale shaving device with dome pins with splines is shown. This is a characterized by a plurality of blade assemblies on thin blade mounts 96, a plurality of blade assemblies on thick blade mounts 97, dome pins with spines 40, a plurality of first rotary blades 20, the base layer 94, a plurality of button portion of snap button fastener 54 and protective peel off layer 50.

Figure 17:
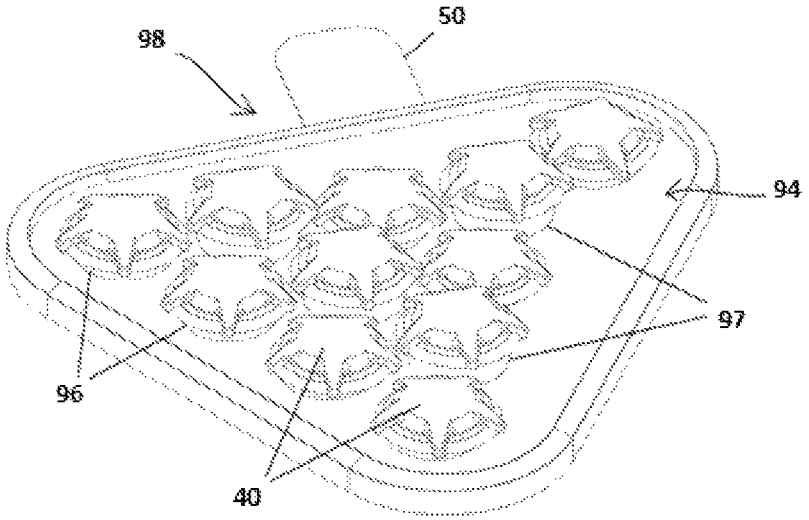
FIG. 17 depicts a perspective view of a shaving device with a plurality of single blade shaver assemblies of different heights, with dome pins having caps with spines, in one embodiment of the invention, referred as the fish scale shaver.

Referring to FIG. 17, a perspective view of fish scale shaving device 98 using dome pins with splines is shown. This is characterized by a plurality of blade assemblies on thin blade mounts 96, a plurality of blade assemblies on thick blade mounts 97, dome pins with spines 40, a plurality of first rotary blades 20, the base layer 94 and protective peel off layer 50.

Figure 18:
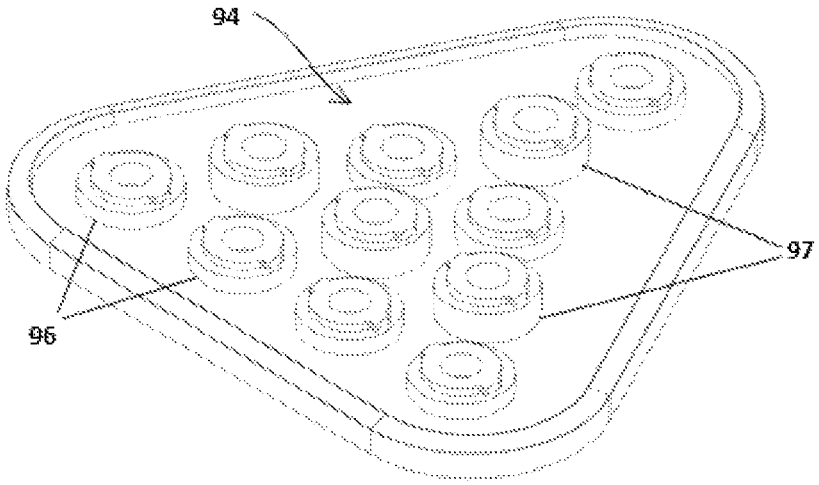
FIG. 18 depicts a perspective view of a base layer with base mounts of the fish scale shaver assembly in one embodiment of the invention.

Referring to FIG. 18, a perspective view of base layer 94 of fish scale shaving device is shown for clarity. This is a characterized by a plurality of thin blade mounts 96 and a plurality of thick blade mounts 97, which are provided as an integral unit of 94.

Figure 19:
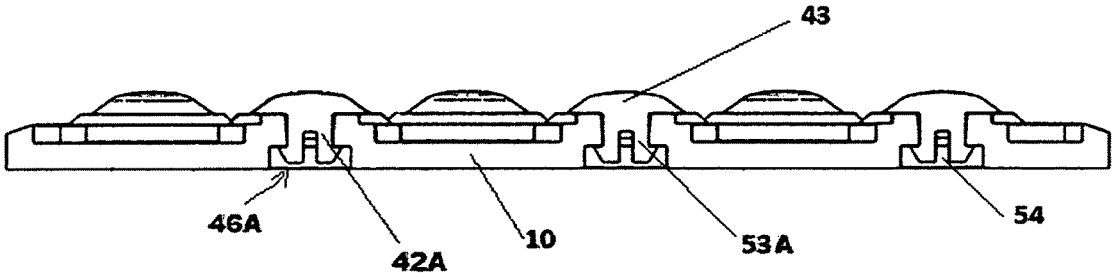
FIG. 19 depicts a vertical cross-section perspective view of a first shaving surface in one embodiment of the invention.

Referring to FIG. 19, a vertical cross-sectional view of base layer 10 having blade assemblies as in any of the previously described embodiments is shown. Hemispherical cap of dome pins without spines, 43, extends downward into vertical stem 42A which further extends downwards into a snap button fastener 46A. 46A comprises of a cap portion 53A and button portion 54 which engage with each other to hold the blade assemblies in place. Additionally, an adhesive means may also be used to ensure that the snap button fattener cap and button remain engaged with each other after securing the blade assembly.

Figure 20:
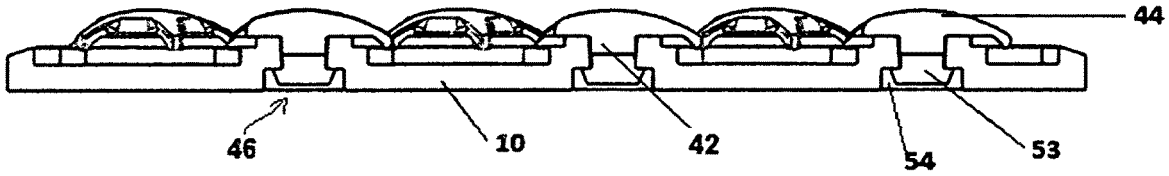
FIG. 20 depicts a vertical cross-section perspective view of a first shaving surface in an alternate embodiment of the invention.

Referring to FIG. 20, a vertical cross-sectional view of base layer 10 having blade assemblies as in any of the previously described embodiments is shown. Hemispherical cap of dome pins with spines, 44, extends downwards into vertical stem 42 which further extends downwards into a snap button fastener 46. 46 comprises of a cap portion 53 and button portion 54 which engage with each other to hold the blade assemblies in place. Additionally, in a preferred embodiment, an adhesive means may also be used to ensure that the snap button fastener cap and button remain engaged with each other after securing the blade assembly.

Figure 21:
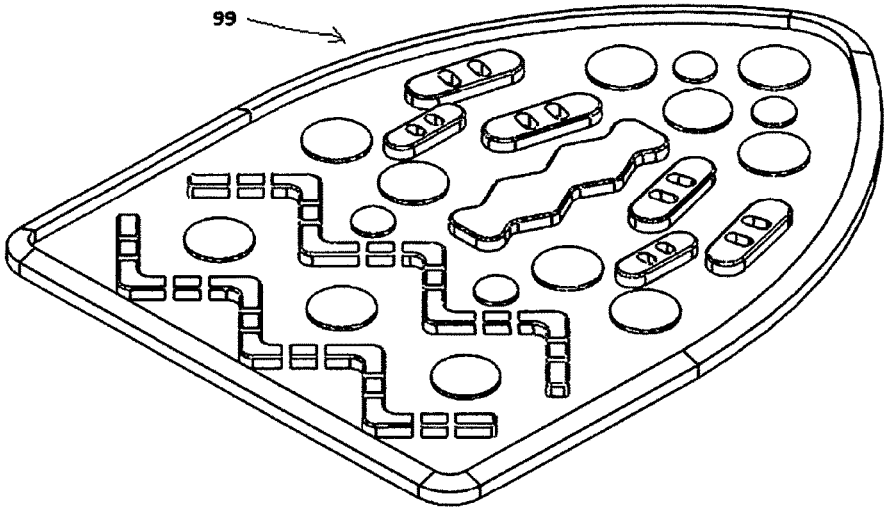
FIG. 21 depicts a perspective view of a scrubber in one embodiment of the invention.

Referring to FIG. 21, a perspective view of the scrubber 99 is shown. The scrubber is an embodiment of the invention wherein no blades are provided and a predetermined raised pattern is provided on the base layer to achieve cleaning and scrubbing action.

The shaving device includes a first shaving surface and a second adhesive surface provided on the opposite side to said first shaving surface across a transversal axis.

A plurality of breathable openings are provided on the flexible substrate layer to make it breathable and are thus present in a coinciding manner at predetermined locations on first shaving surface and second adhesive surface.

The rotary blades are preferably made of stainless steel or carbide steel. The dome pins are preferably constructed out of a plastic material.

The protective peel off layer may be connected to the second adhesive surface either completely, substantially or partly.

In a preferred embodiment of the invention, the diameter of rotary blades is in the range of 1 mm to 2 mm.

In a preferred embodiment of the invention, the flexible, waterproof and breathable substrate layer of the shaving device is made of a material such as latex based, non-latex based, natural or synthetic fibres. Equivalent commercially available forms of such substrate layer include products such as BAND-AID® (Johnson & Johnson), ELASTOPLAST® (Beiersdorf AG).

In a preferred embodiment of the invention, the shape of blades is circular.

In an embodiment of the invention, the adhesive coating on the second adhesive surface may be a substance such as a hypoallergenic pressure sensitive adhesive suitable for application on human skin as acrylic or silicone based adhesive material thereby providing the additional benefit of "stay in place" functionality.

In a preferred embodiment of the invention, the shape of the shaving device is designed in a shape similar to the finger tip of an adult human being.

In an embodiment of the present invention, the shaving device is configured to cover the entire distal end of the finger including the surfaces of the fingertip, the finger nail plate and the finger nail grooves.

In another embodiment of the present invention, the shaving device is configured to cover a finger either in part or as a whole.

In another embodiment of the present invention, the number of blade assemblies on the first shaving surface is in the range of 4 to 30 for a fingertip surface area admeasuring about 400 sq.mm to 600 sq. mm.

In an embodiment of the present invention, the thickness of the flexible substrate layer characterizing the shaving device is in the range of 0.016 mm to 0.024 mm.

In an embodiment of the present invention, the thickness of the protective peel off layer is in the range of 0.016 mm to 0.025 mm.

In an embodiment of the present invention, the thickness of rotary blades is in the range of 0.2 mm to 0.25 mm.

In an embodiment of the present invention, the height of the hemispherical protective cap with a vertical stem is in the range of 0.2 mm to 0.25 mm.

In an embodiment of the present invention, the flexible substrate layer characterizing the shaving device may not be provided with breathable openings.

For using the fingertip shaving device, the user will first remove the protective peel off layer and mount the device onto the fingertip. During the shaving, the contact between the user's leading finger and skin facilitates control of the device and the pressure being applied to achieve desired finish and closeness of the shave. The user can move the device in any direction. The shaving device is sized to easily and safely reach difficult to access areas such as within nose or ears and loose or wrinkled skin along the contour of the shaving surface.

In an embodiment of the present invention, described as a shaver with single blade assemblies, the fingertip mountable shaving device characterized by a flexible substrate layer comprises a (i) a first shaving surface, further comprising
  (a) a base layer characterized by a plurality of blade mounts provided at predetermined locations as a single integral unit,
    wherein a blade mount is characterized by a predetermined thickness and diameter, has a central opening, and a predetermined number of notch engagement portions,
  (b) a plurality of single blade assemblies,
  (c) a rubber strip running along the vertical peripheral edge of the first shaving surface;

wherein a member of the plurality of single blade assemblies further includes:
  a first rotary blade of a predetermined diameter and having a central opening, and characterized by a complementary number and configuration of notches to engage with the notch engagement portions of the blade mount,
  a dome pin characterized by a vertical stem and extending upwards into a hemi-spherical protective cap and extending downwards into a snap button fastener, wherein the dome pin is positioned vertically above the first rotary blade such that the vertical stem extends through the central opening of the first rotary blade and the central opening of the blade mount respectively, (ii) a second adhesive surface coated with an adhesive and covered with a releasably connected protective peel off layer;

wherein said first shaving surface is attached to said second adhesive surface on the opposite side across a transversal axis, and the snap button fastener includes a cap part and a button part, the button being configured to engage with the cap from the opposite side of the first shaving surface to secure a member of the plurality of blade assemblies on the first shaving surface, the button part then being concealed by the second adhesive surface.

In an embodiment of the present invention, described as a double blade assembly, a member of said plurality of blade assemblies, further includes:

a second rotary blade of a predetermined diameter and having a central opening, and characterized by a complementary number and configuration of notches to engage with the notch engagement portions of the blade mount, a first rotary blade of a predetermined diameter and having a central opening, and characterized by a complementary number and configuration of notches to engage with the notch engagement portions of the blade mount, a dome pin characterized by a vertical stem and extending upwards into a hemi-spherical protective cap and extending downwards into a snap button fastener, wherein the dome pin is positioned vertically above the second rotary blade and the first rotary blade such that the vertical stem extends through the central opening of the second rotary blade, the central opening of the first rotary blade and the central opening of the blade mount respectively, and the second rotary blade has a smaller diameter than the diameter of the first rotary blade and is positioned vertically on top of the first rotary blade.

In alternate embodiments, dome pins with or without spines may be used. The spines cover the sharp edges of the blade and having a tapering thickness towards the outer edges.

In an embodiment of the present invention, described as a fish scale assembly, the plurality of blade mounts provided at predetermined locations on the base layer as a single integral unit are characterized by different thickness. In a preferred embodiment, the blade mounts may be of two different thickness, thus referring to them as thin blade mounts and thick blade mounts respectively.

Two different heights of the blade mounts have been provided in similar manner as a fish scale, to create the effect of one continues blade, and at the same time providing a bendable and flexible shaver to contour the skin surface. This gets the blade edges closer to each, and the odds of the blade hitting a hair is higher due to the smaller footprint area occupied by the blade assembly and results in a faster shave since the blades at different heights makes their edges closer to each other. The triangular shape of the shaver helps to keep blades edges overlapping each other. In a preferred embodiment the shape of the shaving device is substantially triangular.

In a preferred embodiment, the fish scale shaver uses a single blade shaver assembly. An advantage of this embodiment is that there is no need to create two sizes of blades to get the double blade shaving results and it keeps the height of the assembly to a minimum for shaving inside the nose. Also the smaller base fits on small fingers and fits the nose better. The triangular shave makes it easy to point inside the nose and can be inserted in any of the three points. The triangular shape hence helps to make the fish scale configuration more efficient to cover more surface area.

In an embodiment of the present invention, described as a scrubber, using the same material as that of the base layer member, a disposable, finger tip mountable scrubber is provided for cleaning of outer-ear and nose and face surface. This embodiment does not use any blade assembly but only a predetermined configuration pattern.

The configuration, shape and flexibility of the material makes it an excellent tool to clean the outside and behind the ears.

The present invention also helps to reduce the cost and manufacturing time and is also easier to assemble. The spines added on the dome pin cap prevent accidental cuts to the skin by adding protective spins to cover the pointed edges of the blade.

With the modified dome pin (with and without the spines) and the snap button assembly the overall thickness of the fingertip shaving device is 1.55 mm, which makes it easy for shaving inside the nose. The number of parts is less and the blade assemblies are securely held in a tight structure. The components do not get separated due the weakness of the adhesive with time.

While the invention has been described with reference to above embodiments, additional modifications can be made without departing from the spirit and scope of the invention as a whole.

The invention claimed is:

1. A flexible, fingertip mountable shaving device comprises (i) a first shaving surface, further comprising (a) a base layer characterized by a plurality of blade mounts provided at predetermined locations as a single integral unit, wherein each of the blade mounts is characterized by a predetermined thickness and diameter, has a central opening, and has a predetermined number of notch engagement portions, (b) a plurality of single blade assemblies, wherein at least one of the single blade assemblies has a different height than another of the single blade assemblies, (c) a rubber strip running along a vertical peripheral edge of the first shaving surface; wherein a member of the plurality of single blade assemblies further includes:

a first blade of a predetermined diameter and having a central opening, and characterized by a complementary number and configuration of notches to engage with the notch engagement portions of the blade mount, a dome pin characterized by a vertical stem and extending upwards into a hemi-spherical protective cap and extending downwards into a snap button fastener, wherein the dome pin is positioned vertically above the first blade such that the vertical stem extends through the central opening of the first blade and the central opening of the blade mount respectively, (ii) a second adhesive surface coated with an adhesive and covered with a releasably connected protective peel off layer;

wherein said first shaving surface is attached to said second adhesive surface on an opposing side across a transversal axis of the base layer, and the snap button fastener being configured to engage with the cap on opposing sides of the base layer to secure the member of the plurality single blade assemblies on the first shaving surface, the snap button fastener then being recessed relative to the second adhesive surface.

2. The fingertip mountable shaving device as claimed in claim 1, wherein at least one of the blade mounts has a different height than another of the blade mounts.

3. The fingertip mountable shaving device as claimed in any of the claims 1 or 2, wherein the hemispherical protective cap of the dome pin is characterized with a plurality of projections along a peripheral edge of the protective cap positioned above a sharp a edge of the blade and having a tapering thickness towards outer edges of the projections.

4. The fingertip mountable shaving device as claimed in any of the claims 1 or 2, wherein the shape of the device is triangular with rounded corners and the device is suitable for shaving hair from a nose.

5. The fingertip mountable shaving device according to any of the claims 1 or 2, wherein the diameter of the blade has a value in the range of 1 mm to 2 mm.

6. The fingertip mountable shaving device according to any of the claims 1 or 2, wherein the total thickness of the shaving device has a value in the range of 0.016 mm to 1.55 mm.

7. The fingertip mountable shaving device according to any of the claims 1 or 2, wherein the thickness of the protective peel off layer has a value in the range of 0.016 mm to 0.025 mm.

8. The fingertip mountable shaving device according to any of the claims 1 or 2, wherein the provided number of blade assemblies has a value in the range of 4 to 30 in a surface area of 400 sq.mm to 600 sq.mm.

9. The fingertip mountable shaving device according to any of the claims 1 or 2, wherein the shape of the blade is circular.

10. The fingertip mountable shaving device according to any of the claims 1 or 2, wherein the adhesive coated on second adhesive surface is hypoallergenic and pressure sensitive.

11. The fingertip mountable shaving device according to any of the claims 1 or 2, wherein the base layer is made of a material selected from a group consisting of latex based and synthetic fibers.

12. The shaving device according to any of the claims 1 or 2, wherein the shaving device is configured to cover a partial surface of an entire finger.

* * * * *